US011138959B2

(12) United States Patent
Vochezer

(10) Patent No.: US 11,138,959 B2
(45) Date of Patent: Oct. 5, 2021

(54) FINE TUNER FOR A STRING MUSICAL INSTRUMENT, AND STRING MUSICAL INSTRUMENT

(71) Applicant: Wittner GmbH & Co. KG, Isny (DE)

(72) Inventor: Georg Vochezer, Argenbuehl-Christazhofen (DE)

(73) Assignee: Wittner GmbH & Co. KG, Isny (DE)

( * ) Notice: Subject to any disclaimer, the term of this patent is extended or adjusted under 35 U.S.C. 154(b) by 0 days.

(21) Appl. No.: 16/949,738

(22) Filed: Nov. 12, 2020

(65) Prior Publication Data

US 2021/0074248 A1 Mar. 11, 2021

Related U.S. Application Data

(63) Continuation of application No. PCT/EP2019/062590, filed on May 16, 2019.

(30) Foreign Application Priority Data

May 18, 2018 (DE) ..... 102018112086.9

(51) Int. Cl.
*G10D 3/14* (2020.01)
*G10D 1/12* (2006.01)

(52) U.S. Cl.
CPC ..... *G10D 3/14* (2013.01); *G10D 1/12* (2013.01)

(58) Field of Classification Search
CPC ..... G10D 3/14; G10D 1/12; G10G 7/02
See application file for complete search history.

(56) References Cited

U.S. PATENT DOCUMENTS

| | | | | |
|---|---|---|---|---|
| 3,515,026 | A * | 6/1970 | Rohrbough | G10D 3/09 84/286 |
| 4,549,460 | A | 10/1985 | Gressett, Jr. et al. | |
| 2010/0326255 | A1 * | 12/2010 | Bryant | G10D 1/12 84/317 |
| 2016/0307547 | A1 | 10/2016 | Artino | |

FOREIGN PATENT DOCUMENTS

| | | |
|---|---|---|
| AT | 91268 | 2/1923 |
| CN | 206789276 | 12/2017 |
| DE | 7001625 | 5/1970 |
| DE | 7228818 | 11/1972 |
| DE | 4402895 | 3/1995 |
| DE | 102008064418 | 7/2010 |
| GB | 2463929 | 4/2010 |

* cited by examiner

*Primary Examiner* — Kimberly R Lockett
(74) *Attorney, Agent, or Firm* — Lipsitz & McAllister, LLC

(57) ABSTRACT

A fine tuner for a string musical instrument, comprising a main body having an underside, a top side, a first abutment region and having a second abutment region for a string, wherein the second abutment region is spaced apart from the first abutment region, a gripping element for gripping a string portion that is located between the first abutment region and the second abutment region, and an adjusting device, which sits on the main body and acts on the gripping element, wherein a position of the gripping element relative to the main body is adjustable in a fixable manner using the adjusting device and the position of the gripping element determines a deflected position of the string at the fine tuner, and wherein the gripping element entrains the string portion counter to a direction that extends in a direction from the top side to the underside.

46 Claims, 14 Drawing Sheets

FINE TUNER FOR A STRING MUSICAL INSTRUMENT, AND STRING MUSICAL INSTRUMENT

This application is a continuation of international application number PCT/EP2019/062590 filed on May 16, 2019 and claims the benefit of German application number 10 2018 112 086.9 filed on May 18, 2018, which are incorporated herein by reference in their entirety and for all purposes.

BACKGROUND OF THE INVENTION

The invention relates to a fine tuner for a string musical instrument.

Document DE 10 2008 064 418 A1 discloses a tailpiece for a string instrument with a fine tuner. The tailpiece is attached to an end of a body of the string instrument opposite a pegbox.

Document AT 91268 discloses a device for string instruments to regulate the tonal sounds of strings.

Document DE 7 001 625 discloses a fine tuning device for the strings of plucked instruments.

Document DE 7 228 818 discloses a string tuner for string instruments.

In accordance with an embodiment of the invention, a fine tuner is provided which is constructed in a simple and compact manner and with which the fine tuning of strings, and in particular of strings which are arranged closely together, can be achieved in a simple and precise manner.

SUMMARY OF THE INVENTION

In accordance with an embodiment of the invention, a fine tuner is provided with a main body having an underside, a top side, a first abutment region and a second abutment region for a string, wherein the second abutment region is spaced apart from the first abutment region, a gripping member for gripping a string portion that is located between the first abutment region and the second abutment region, and an adjusting device, which sits on the main body and acts on the gripping element, wherein a position of the gripping element relative to the main body is adjustable in a fixable manner by means of the adjusting device and the position of the gripping element determines a deflected position of the string at the fine tuner, and wherein the gripping element entrains the string portion counter to a direction that extends in a direction from the top side to the underside.

The fine tuner according to the invention can be formed in a simple and compact way. In particular, it can be formed with relatively small width dimensions (perpendicular to a height direction). Such a fine tuner can then be used, for example, for zither instruments where a large number of strings are relatively close together. In particular, a separate fine tuner can then be used for each string.

With the adjusting device, a string tension can be adjusted in a simple and precise way by deflecting a region of the string by means of the gripping element at the fine tuner, thus enabling fine tuning to be achieved.

In principle, a fine tuner according to the invention can be used on a played region or an unplayed region of a string.

Due to the compact construction of the fine tuner, it can also be positioned between a bridge and a holding peg, for example, and thus can be used advantageously for a zither instrument.

By using a fine tuner according to the invention, a slip-effect at a holding peg can be avoided. The gripping element and the adjusting device allow precise adjustment by adjusting a deflection of the string at the fine tuner (relative to the main body) without slip-stick effect.

The fact that the gripping element entrains the string portion counter to a direction running from the top side to the underside of the main body and thus, in particular, lifts it away from a body of the string musical instrument means that the fine tuner according to the invention can be subsequently placed on a string even when space is tight to achieve fine tuning. The fine tuner does not have to be mounted on the musical instrument itself. In particular, it is possible to achieve a deflection of the string portion away from the body of the musical instrument. This allows fine tuning when space is tight, as is the case for example with a zither as a musical instrument.

In addition, it can thus also be ensured, by way of a structurally simple construction, that the string tuner itself forms abutment surfaces for a deflection of the string portion, so that it can be subsequently placed on a string and does not have to be permanently mounted to the musical instrument.

In particular, the gripping element causes the string to be pulled away from a body of the musical instrument in order to achieve fine tuning.

The deflection of the string at the fine tuner can be, for example, a pure deflection in a height direction, or can also include a mixture of height deflection and cross deflection.

It is expedient if a height position of the gripping element along a height direction relative to the first abutment region and the second abutment region is adjustable in a fixable manner, and/or if a rotational position of the gripping element about an axis of rotation parallel to the height direction is adjustable in a fixable manner. In this way, a deflection of a string region can be adjusted at the fine tuner and fine tuning can be carried out. The deflection can be achieved by displacing a certain string region and/or by a rotary movement for a certain string region. In particular, the direction between the top side and the underside of the main body is parallel to or coaxial with the height direction or lies along the height direction.

It is very particularly advantageous if a displacement guide for the gripping element is arranged on the main body. In this way, the gripping element can be easily fixed in a desired position. In this way, a precise fine tuning can be achieved.

In a structurally advantageous embodiment, the displacement guide has a sleeve in which the gripping element is guided. In this way, a defined displacement movability for tensioning a string is achieved. Furthermore, it is thus easy to convert a rotary movement of a spindle into a displacement movement of the gripping element, for example. This in turn makes it possible to achieve fine tuning in a simple way.

In one embodiment, a sleeve axis is parallel to a displacement axis of the displacement guide, wherein the displacement axis is parallel to a height direction. This thus results in a simple and compact construction of the fine tuner.

It is expedient if the sleeve has at least one open side. The gripping element can protrude from this open side. This in turn makes it easy to grip a string by the gripping element.

The gripping element then expediently protrudes beyond the open side to enable easy gripping.

It is expedient if a third abutment region for a string is formed on the open side. This allows the fine tuner to be easily attached to a musical instrument. The third abutment region is defined as a kind of stop for the string. This in turn makes it easy to place the string on the first abutment region and on the second abutment region. Furthermore, the third abutment region can be used to guide the string when the height position of the gripping element is being set.

It is very particularly advantageous if the third abutment region has a flat abutment surface which is oriented, in particular, parallel to a displacement axis of the displacement guide. This allows the string to be guided along the third abutment region during a tuning process. This results in a defined position of the string and facilitates fine tuning.

It is very particularly advantageous if the displacement guide is adapted to the gripping element in such a way that the gripping element is guided non-rotatably. This makes it easy, for example, to convert a rotation at the adjusting device into a displacement of the gripping element. The fine tuner can thus be constructed in a structurally simple way and can be made compact.

In one embodiment, a counter element for the gripping element is arranged on the main body and has a shorter height than the displacement guide along a displacement axis, and in particular the counter element is arranged opposite a sleeve of the displacement guide. In particular, for a tuning position of a corresponding string, the counter element can then be used as a kind of cover which prevents the string from slipping off the gripping element.

The counter element expediently delimits a slot for receiving a string and, in particular, forms a kind of wall for this slot. Alternatively or additionally, it can be provided that at a certain height position (and especially tuning position) of the gripping element, a slot of the gripping element is covered by the counter element. This prevents the string from slipping out of the gripping element.

It is also possible to block a rotatability by means of the string, which is held on the gripping element and contacts the main body. In this way it is possible to block the rotatability of the gripping element so to speak by a kind of jamming of the string on the fine tuner. A corresponding fine tuner can be constructed in a simple way.

In particular, the first abutment region and/or the second abutment region then has at least one blocking surface which is oriented parallel to an axis of rotation (initially also of the gripping element). During an initial rotation of the gripping element, the string can then abut against the at least one blocking surface and thus (by means of the orientation parallel to the axis of rotation) further rotation can be blocked, with the rotatability then also being blocked, in turn.

It is advantageous if the first abutment region and/or the second abutment region has opposite blocking surfaces, between which there lies an abutment surface with orientation transverse to the axis of rotation. The oppositely arranged blocking surfaces can be used to block the gripping element against rotation in opposite directions. The abutment surfaces between the blocking surfaces enable the string to be placed against the main body, which allows the string to be deflected in a height direction. If, for example, the corresponding gripping element sits as a nut on a spindle, and the rotatability is blocked as described, then the gripping element moves in a height direction as the spindle continues to rotate. This, in turn, causes a height deflection of the string with the possibility of fine tuning.

In particular, it is then provided that the gripping element has at least one gripping hook with a blocking surface which is oriented parallel to the axis of rotation. During the initial rotation of the gripping element, whilst this is still possible, with the string "hooked in", the string is thus prevented from slipping out by abutting against the blocking surface.

In one embodiment, a plurality of gripping hooks sit on a gripping element and are, in particular, arranged on the gripping element spaced apart and in particular distributed (and preferably uniformly distributed) peripherally in relation to the axis of rotation. This results in a simple operability.

In a structurally simple embodiment that can be realised in a compact way, the adjusting device has a spindle that sits rotatably on the main body and, in particular, is fixed against displacement on the main body. In this way, a rotary movement of the spindle can easily be converted into a linear displacement of the gripping element. This, in turn, makes it easy to tension the string portion that is located between the first abutment region and the second abutment region, in order to perform precise fine tuning.

In particular, the gripping element then sits on the spindle, although the spindle preferably can be rotated relative to the gripping element and in particular an axis of rotation is parallel to a displacement axis of the gripping element. In this way, an active displacement movement of the gripping element can be initiated in a structurally simple way by means of an active rotation of the spindle.

In one embodiment, an actuating element sits on the spindle for conjoint rotation and is outside the main body and, in particular, is positioned above the main body. A user acts on the actuating element to perform a tuning operation. The spindle can be rotated by turning the actuating element, and in particular the gripping element can be displaced. The corresponding fine tuner can be constructed in a compact way.

It is very particularly advantageous if the gripping element has a receptacle to hold the string. This enables the gripping element to grip the string and, in particular, to tension the string at the fine tuner in such a way that precise fine tuning can be carried out.

In a structurally simple embodiment, the receptacle is constructed as a slot and in particular as an annular slot. In this way, a string can be easily received and entrained with the gripping element in order to set a certain tuning by setting a certain height position.

With an alternative construction, the receptacle is formed on a gripping hook. The gripping hook has, in particular, a blocking surface transverse to an axis of rotation. This prevents a string which is sitting in the receptacle from slipping out.

In a structurally simple embodiment, the gripping element is a nut or comprises a nut.

In particular, the nut then comprises a slot as receptacle for the string, or a first nut and a second nut are provided, with a slot being arranged between the first nut and the second nut to accommodate the string. This makes it easy to create a gripping element with a string gripping region.

It is expedient if a further abutment region is then formed on the main body for contact with the body of the string musical instrument. In this way, the fine tuner can be supported downwardly on the body of the string musical instrument (especially on a bridge and/or sounding body). This results in easy tunability with precise adjustability.

In particular, the further abutment region is then formed on an underside of the main body to allow downward support on the string musical instrument. On an opposite side, an actuating element can then be easily positioned, by means of which a user can perform the tuning process.

It is expedient if an actuating element of the adjusting device is positioned facing away from the underside. This allows a user to easily perform a tuning operation.

It is very particularly advantageous if the further abutment region has an abutment surface which is convexly curved. This allows the fine tuner to be placed on the string musical instrument in conforming manner and, in particular, to be supported on a body of the string musical instrument. This results in a wide region of variation regarding the downward support.

In a structurally simple embodiment, the first abutment region and the second abutment region are open to an underside of the main body. This allows the fine tuner to be easily placed on a string for fine tuning this string.

For the same reason, it is expedient if a receiving region of the main body for the string is open to an underside of the main body. This makes it easy, for example, to position the string to be tuned on the gripping element and, in particular, to engage it in a slot of the gripping element.

In a structurally simple embodiment, the first abutment region and/or the second abutment region are formed at a slot of the main body. This also makes it easy to prevent the string from slipping sideways relative to the main body.

For the same reason, it is expedient if the first abutment region and/or the second abutment region is formed at a slot in a further abutment region of the main body for contact with a body of a string musical instrument.

The fine tuner can be constructed in a compact manner if the gripping element is positioned at least approximately centrally between the first abutment region and the second abutment region, and in particular if it is positioned in a centre plane between the first abutment region and the second abutment region. In particular, a fine tuner with relatively small width dimensions can be provided. This, in turn, allows several fine tuners to be used on one string musical instrument such as a zither, even if adjacent strings are spaced relatively closely together.

In one embodiment, a slot for the string is formed on the main body between the first abutment region and the second abutment region. This makes it easy to achieve fine tuning. For example, the string can be positioned with the slot and a counter element can be used to cover a region where the string can be removed from the gripping element.

It is advantageous if the slot is formed between a sleeve for a displacement guide of the gripping element and a counter element positioned on the main body. The string can be brought into the slot by means of the gripping element. The counter element can easily prevent the string from leaving the gripping element.

Advantageously, the main body has a length in a length direction between the first abutment region and the second abutment region which is greater than a width in a width direction transverse to the length direction and in particular is at least 1.2 times greater than the width. This enables a compactly constructed fine tuner to be realised, which in particular has minimised width dimensions. This, in turn, allows a number of fine tuners to be used on the strings of a string musical instrument such as a zither, where the adjacent strings are spaced relatively closely together.

In one embodiment, the main body has at least one open side, which is oriented transversely to an underside of the main body, with at least one free region being formed on the main body on the at least one open side, which free region is delimited upwardly in the height direction by a region of the main body, and which is configured in particular to allow a string to pass through and/or to receive a string.

A string can be inserted by means of the open side so as to thus easily couple to the gripping element. This makes it easy for a user to place a fine tuner on a string and achieve a coupling to the gripping element. A free region can also be configured in such a way that it receives an adjacent string of a string to be tuned and, in particular, receives without contact. This allows the fine tuner to be used on a string musical instrument, such as a zither musical instrument, where the adjacent strings are spaced relatively closely together. The main body can then also cover an adjacent string without the fine tuner touching the string adjacent to the string that is to be tuned.

In one embodiment, a sleeve of a displacement guide delimits the at least one free region and, in particular, an open side of the sleeve faces the at least one free region. This makes it easy to couple a string to be tuned to the gripping element.

It is expedient if the at least one free region is open downwardly in the height direction. This makes it easy to position the fine tuner on a string musical instrument. Furthermore, this results in the possibility for a compact and material-saving production.

It is then provided, in particular, that the main body at the at least one free region is step-shaped. This results in a compact construction.

In one embodiment, the main body has a first region, where the first abutment region and the second abutment region are formed, and has a second region, where the adjusting device sits, the second region sitting in domelike manner on the first region and an actuating element of the adjusting device being positioned above the second region. The first region serves in particular for the contact of the corresponding string portion and defines the length and preferably also the width of the fine tuner. The second region defines the height of the fine tuner in the height direction. This results in a compact material-saving construction of the fine tuner.

In particular, a fine tuner according to the invention is used for a zither instrument such as a zither or table harp.

In accordance with the invention, a string musical instrument is provided which comprises at least one fine tuner according to the invention.

In particular, it is provided that the at least one fine tuner is positioned on a string region between a bridge and a holding peg. This makes it easy to achieve precise tunability of a corresponding string.

In one embodiment, it is provided that the fine tuner is supported by the main body with a further abutment region on a body of the string musical instrument, and in particular support on a bridge and/or a sounding body is provided. Such an additional support results in the possibility of simple and precise fine tuning for a string.

The following description of preferred embodiments serves in conjunction with the drawings to explain the invention in greater detail.

BRIEF DESCRIPTION OF THE DRAWINGS

FIG. 7(*b*) shows the same view as FIG. 6 in an intermediate position;

FIG. 9(*b*) shows the same view as FIG. 8 in an intermediate position;

FIG. 11(*b*) shows the same view as FIG. 10 in an intermediate position;

DETAILED DESCRIPTION OF THE INVENTION

Figure 1:
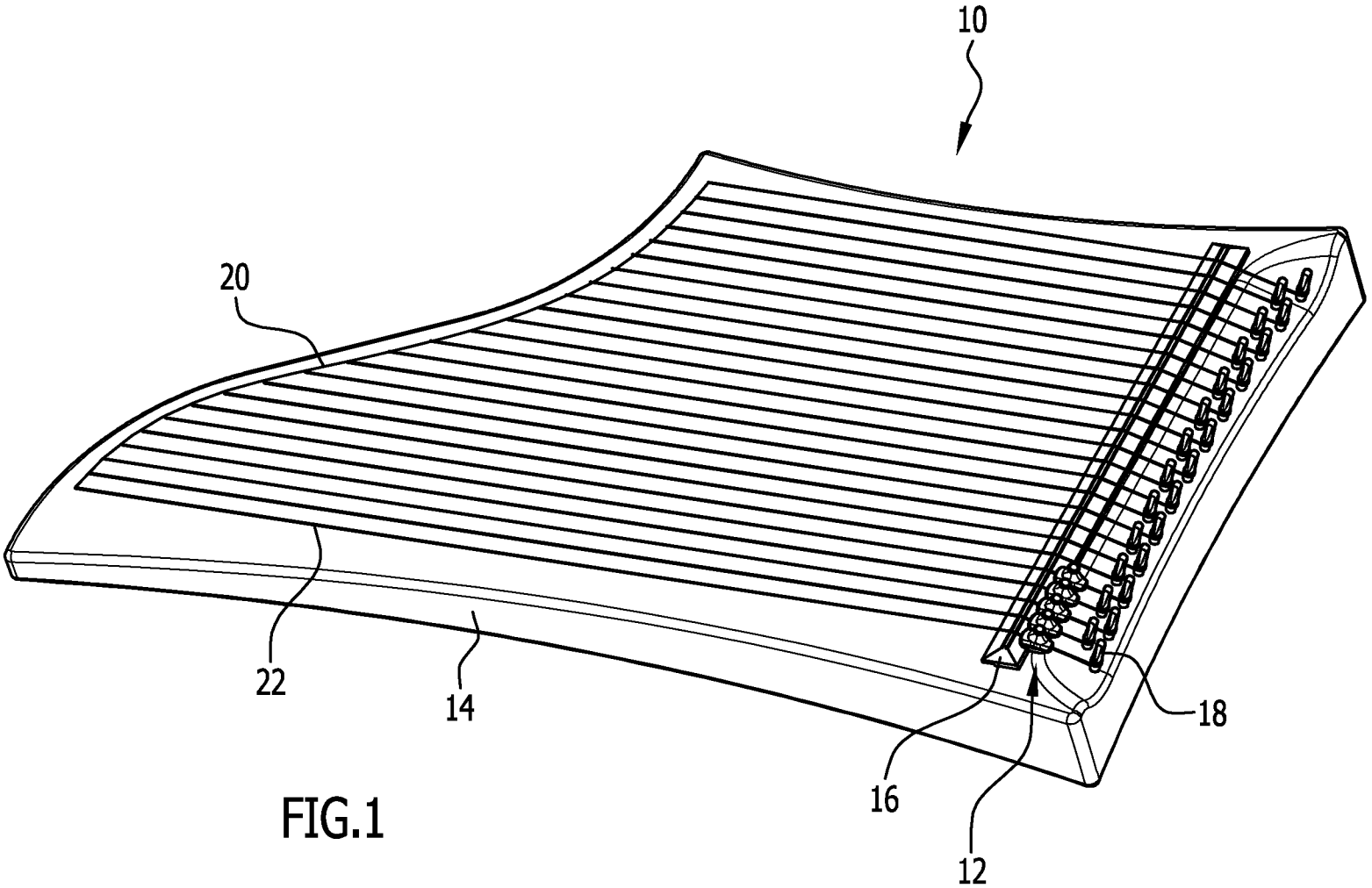
FIG. 1 shows an example of a string musical instrument, namely a zither, on which embodiments of a fine tuner are arranged.
Figure 2:
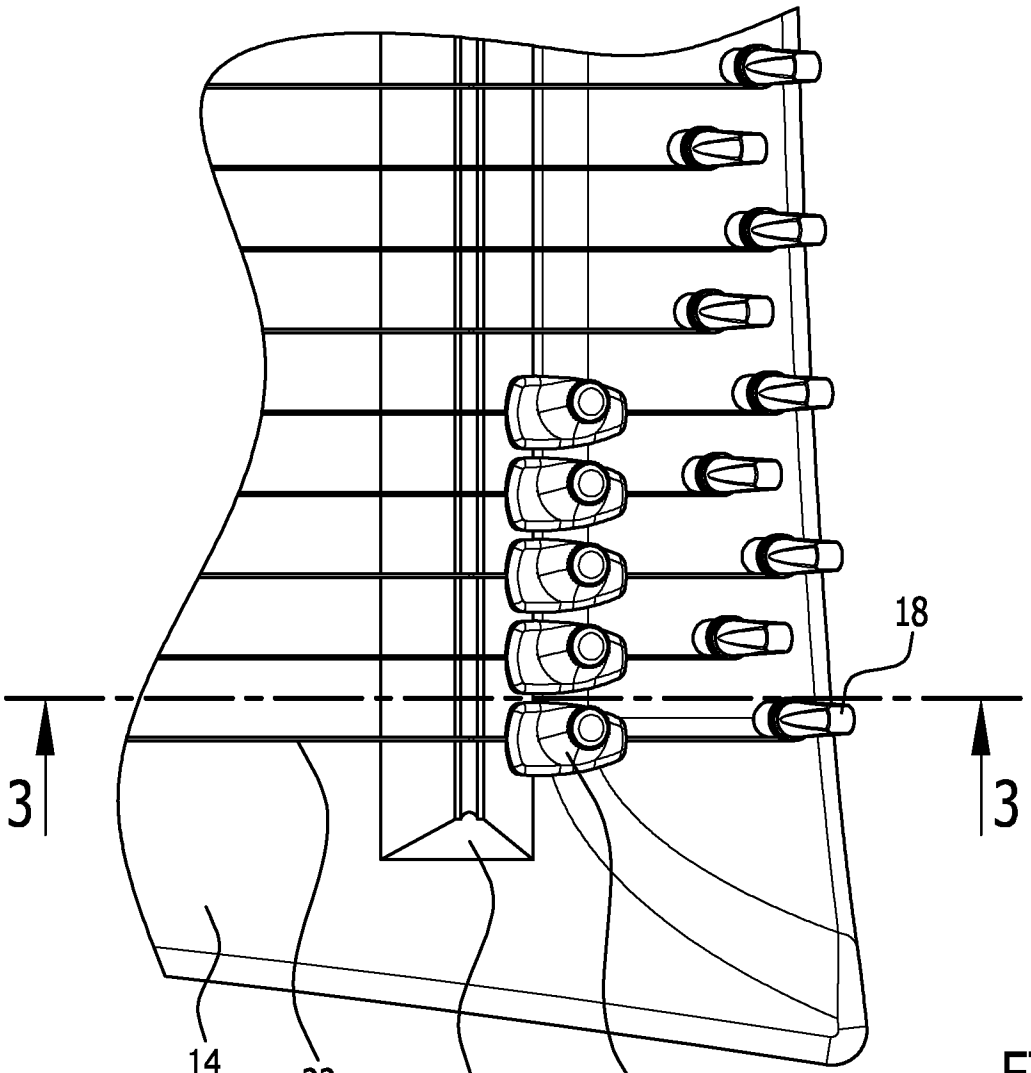
FIG. 2 shows a detailed view of the zither according to FIG. 1 in a plan view.

An example of a string musical instrument 10 (FIGS. 1 to 3) on which fine tuners 12 according to the invention can be used is a zither instrument and in particular a zither.

Such a string musical instrument 10 comprises a sounding body 14. A bridge 16 sits on the sounding body 14.

A plurality of holding pegs 18 are also arranged on the sounding body.

Furthermore, a string holder 20 is arranged on the sounding body 14.

The strings 22 run between the string holder 20 and corresponding holding pegs 18, in particular with adjacent strings 22 being arranged at least approximately in parallel. The strings 22 are guided over the bridge 16, They are firmly fixed to the string holder 20. The strings 22 are fixed to the corresponding holding pegs 18, in particular by being wound around said pegs.

The holding pegs 18 are arranged basically rotatably on the sounding body 14. By turning a holding peg 18 with a string 22 wound around it, the string tension can be adjusted and thus the corresponding string 22 can be tuned.

In principle, the problem with a rotatable holding peg 18 is that the slip-stick effect occurs; due to frictional forces and especially static friction, a certain threshold force value must be exerted in order to cause any rotation at all of a holding peg 18. A jerky rotation may then occur, which goes beyond a desired rotation. This can make fine tuning of strings 22 difficult.

For the fine tuning of strings 22, a fine tuner 12 according to the invention is provided for each string.

In the following, there is designated as the body of the string musical instrument 10 that part which is not string 22. In particular, the body of the string musical instrument 10 comprises the sounding body 14 and the bridge 16.

An example of a fine tuner 12 according to the invention (FIGS. 4 to 12) comprises a main body 24, The main body 24 is in particular formed in one piece.

In one example, the main body 24 is made of a plastics material. It is also possible, in principle, that the main body 24 is made of wood, for example.

The main body 24 has a first region 26. This first region 26 defines a length L of the fine tuner 12 in a length direction 28. It also defines a width B of the fine tuner 12 in a width direction 30 perpendicular to the length direction 28.

The main body 24 also extends in a height direction 32, which is perpendicular to the length direction 28 and the width direction 30.

A length L of one embodiment is approximately 1.5 cm.

A second region 34 of the main body 24 sits on the first region 26. This second region 34 is in particular integrally connected to the first region 26. It sits preferably in a domelike manner on the first region 26 and has an upper end 36. At the upper end 36, the second region 34 is, in particular, flat.

In the example shown, the second region 34 has a smaller length L' in the length direction 28 than the main body 24 with the length L.

In the example shown, it also has a smaller width B' in the width direction 30 than the main body 24 with width B in this width direction 30.

At a transition region 38 from the second region 34 to the first region 26, the main body 24 has no edges and is, in particular, rounded.

The first region 26 has a top side 40, on which the second region 34 is located.

On the top side 40, the first region 26 is free of edges and has rounded edges 42 in particular.

The main body 24 has an underside 44, which faces away from the top side 40 or the upper end 36.

Figure 3:
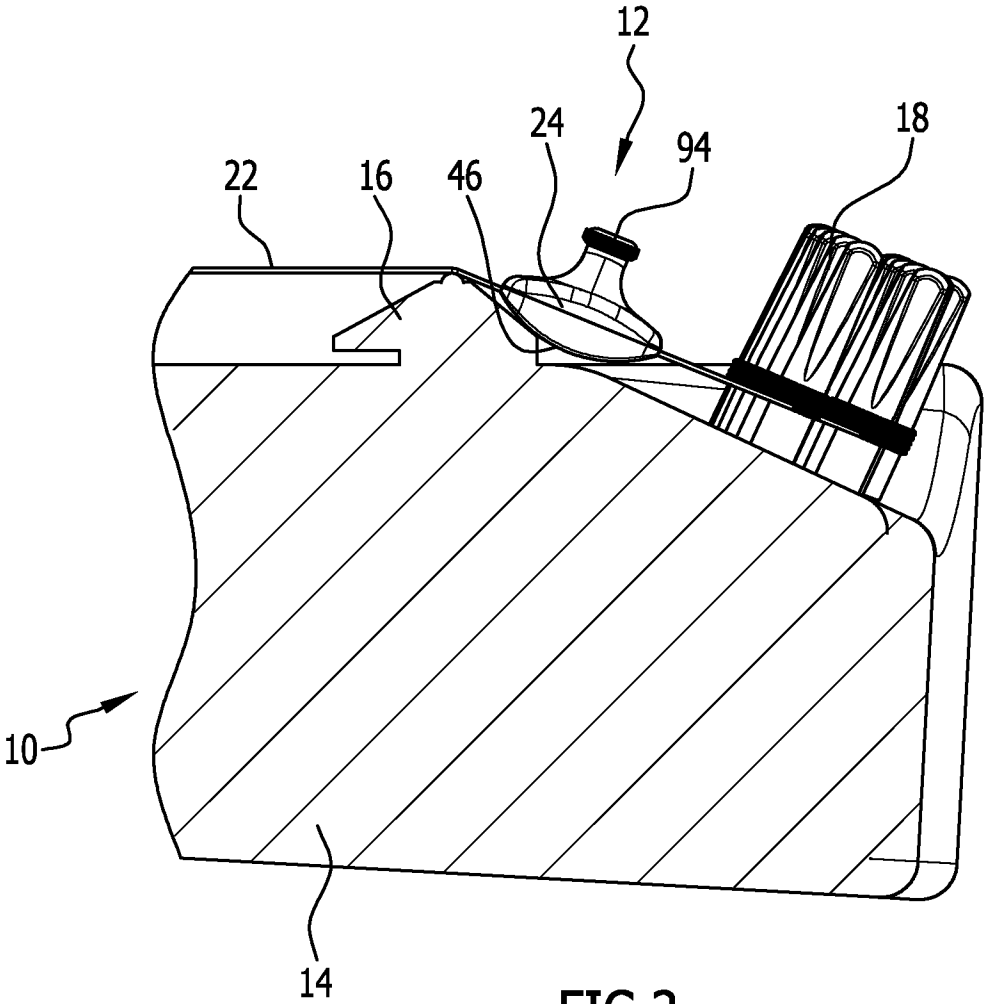
FIG. 3 shows a sectional view along line 3-3 according to FIG. 2.
Figure 4:
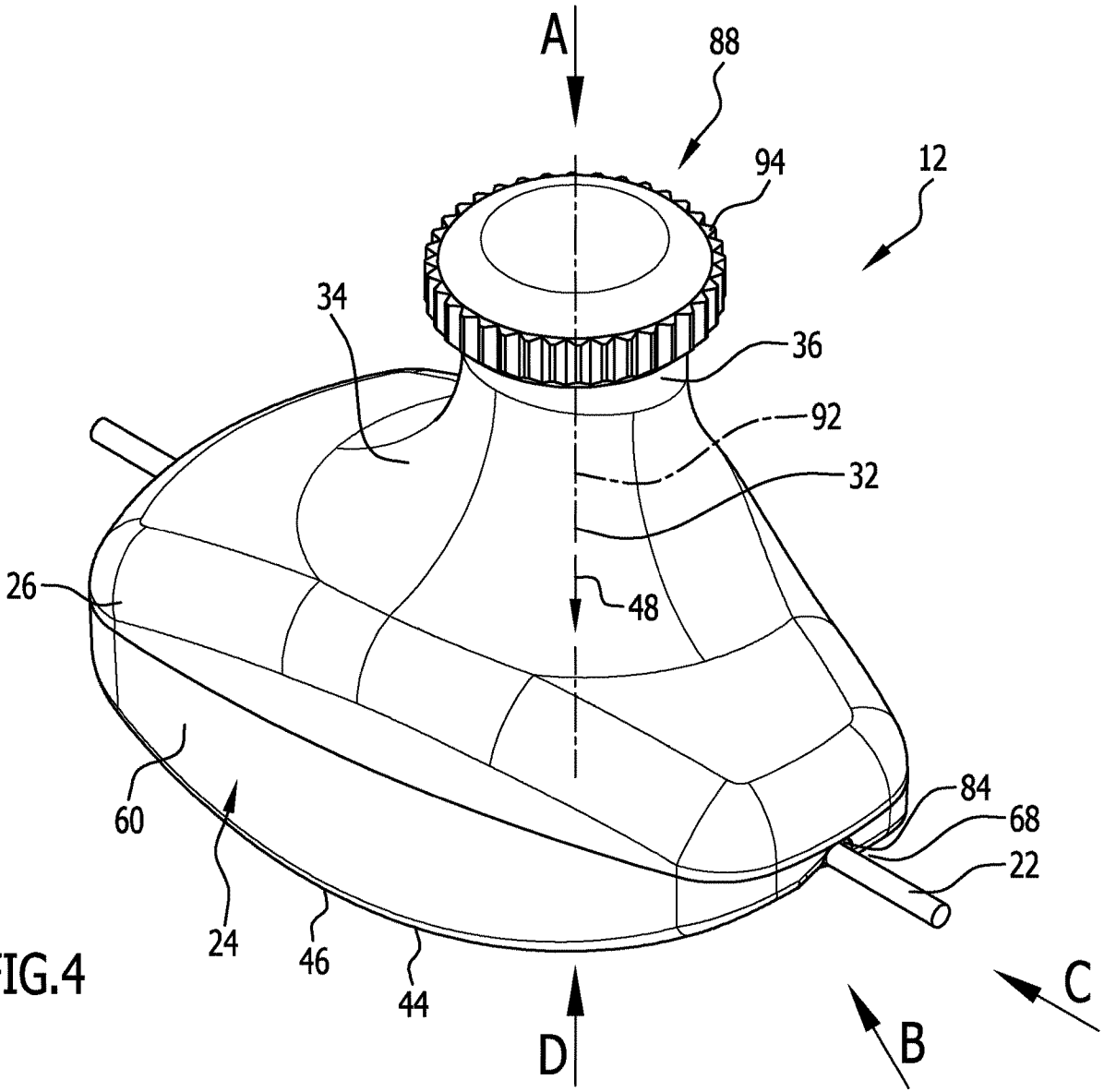
FIG. 4 shows a perspective representation of an example of a fine tuner according to the invention.
Figure 5:
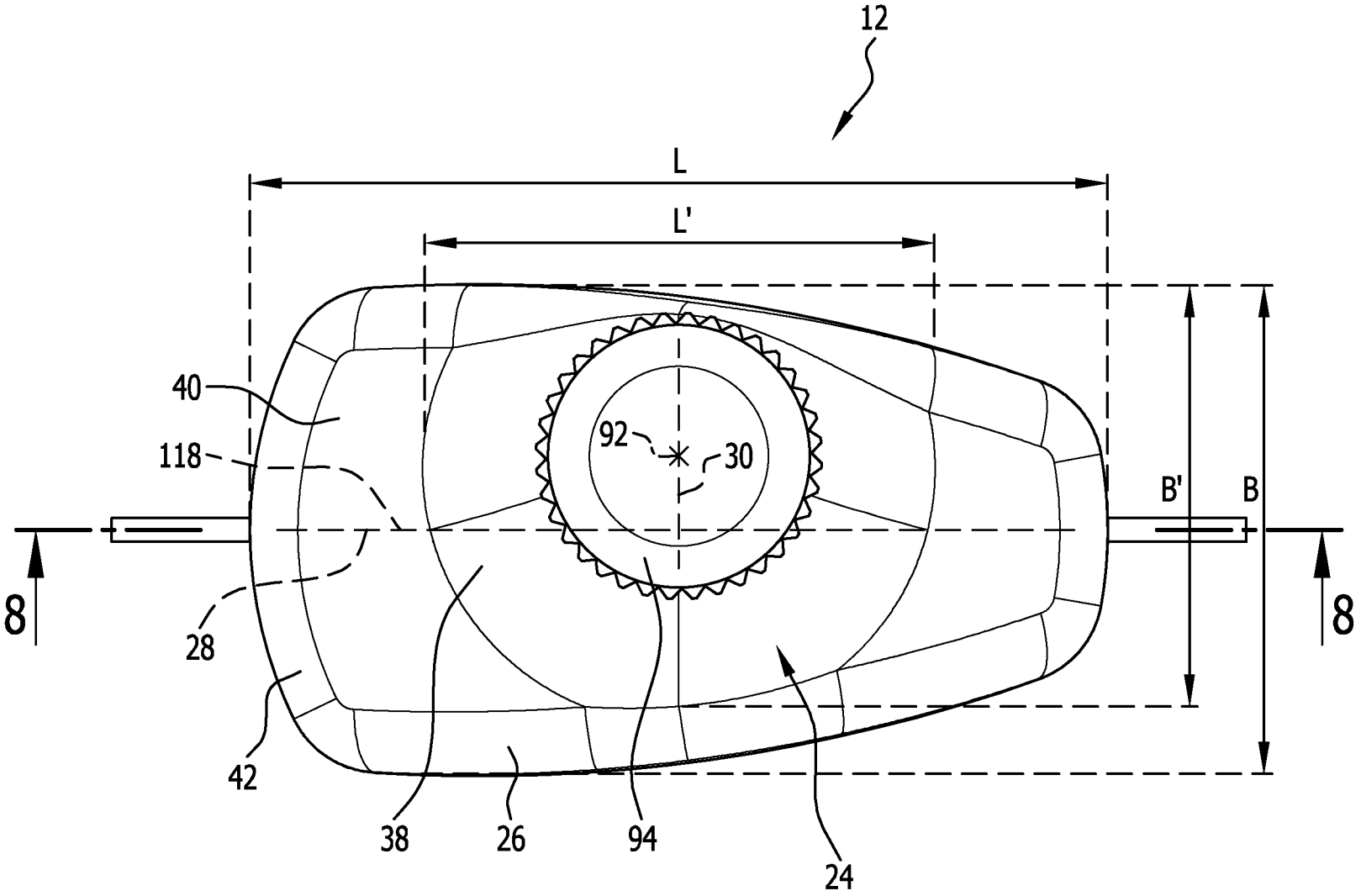
FIG. 5 shows a plan view in the direction A of the fine tuner according to FIG. 4.
Figure 6:
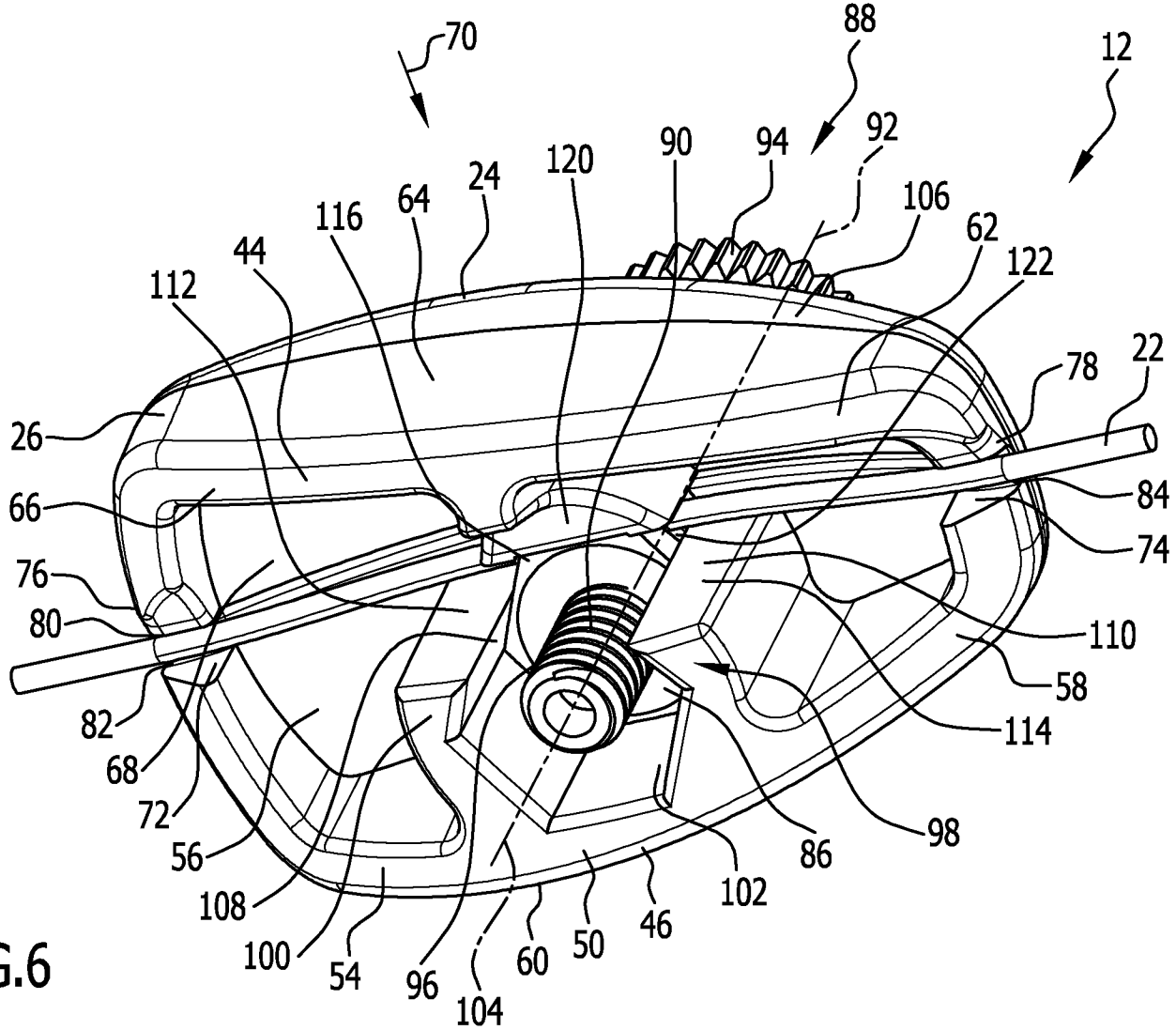
FIG. 6 shows a perspective view from below of the fine tuner according to FIG. 4 in the direction B in a tuning position.

The underside 44 forms a (further) abutment region 46, by means of which the fine tuner 12 with its main body 24 can be placed against a body of the string musical instrument 10 (see FIG. 3).

The abutment region 46 on the underside 44 of the main body 24 is convex (in relation to a direction 48 along the height direction 32 from the upper end 36 towards the underside 44).

Figure 8:
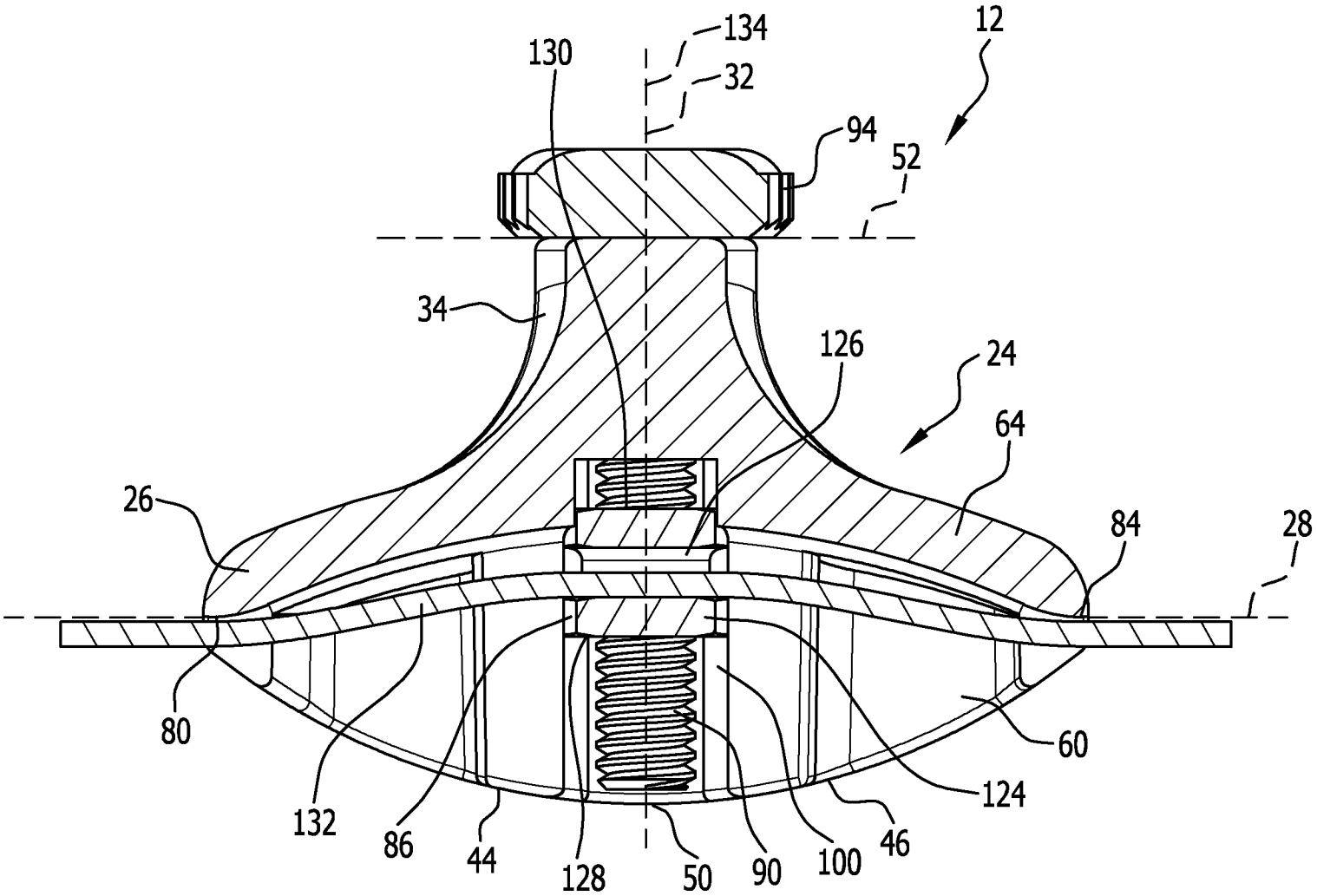
FIG. 8 shows a sectional view along line 8-8 according to FIG. 5 in a tuning position.
Figure 9A:
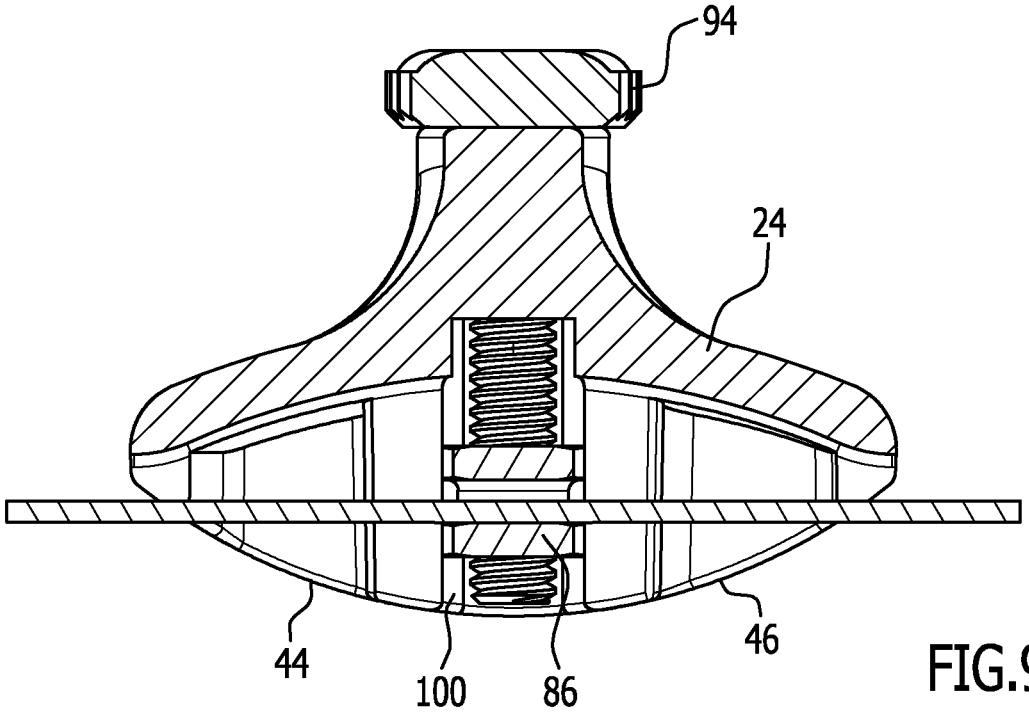
FIG. 9(*a*) shows the same view as FIG. 8 in a starting position.
Figure 9B:
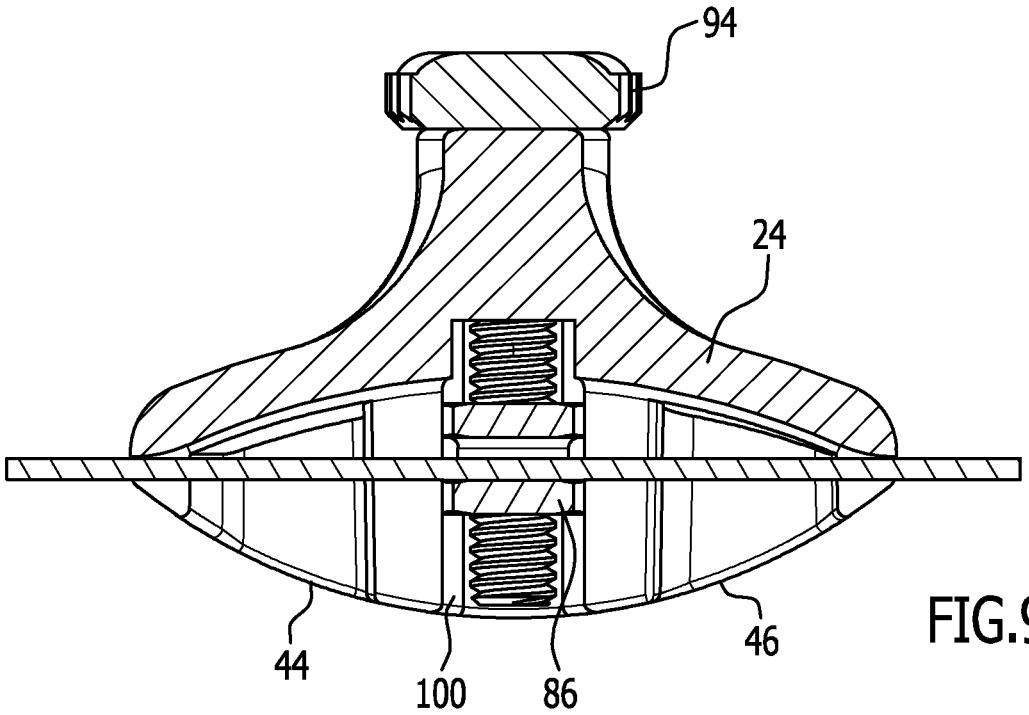
Figure 10:
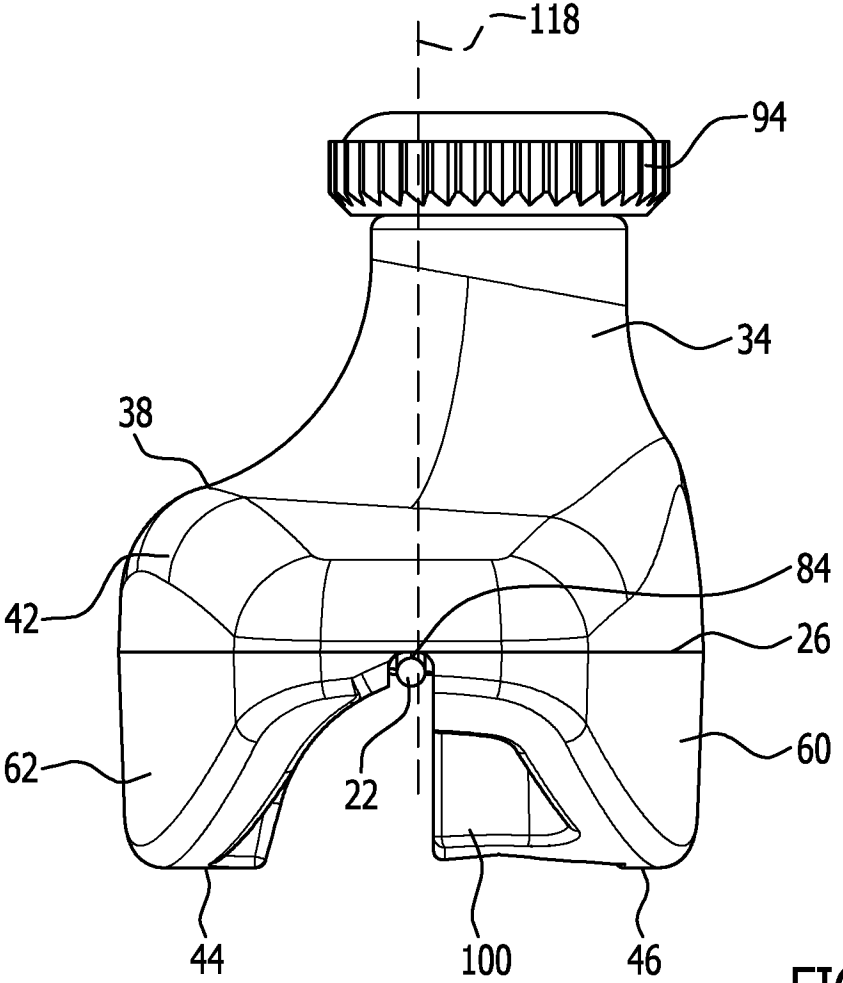
FIG. 10 shows a side view of the fine tuner according to FIG. 4 in the direction C in a tuning position.
Figure 11A:
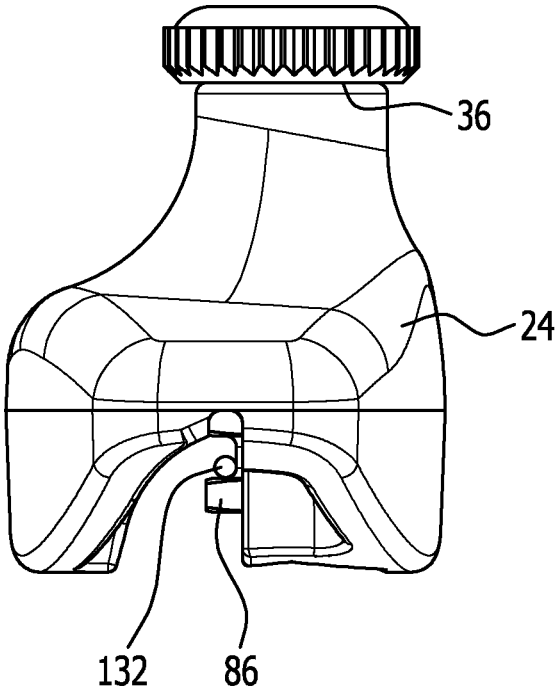
FIG. 11(*a*) shows the same view as FIG. 10 in a starting position.
Figure 11B:
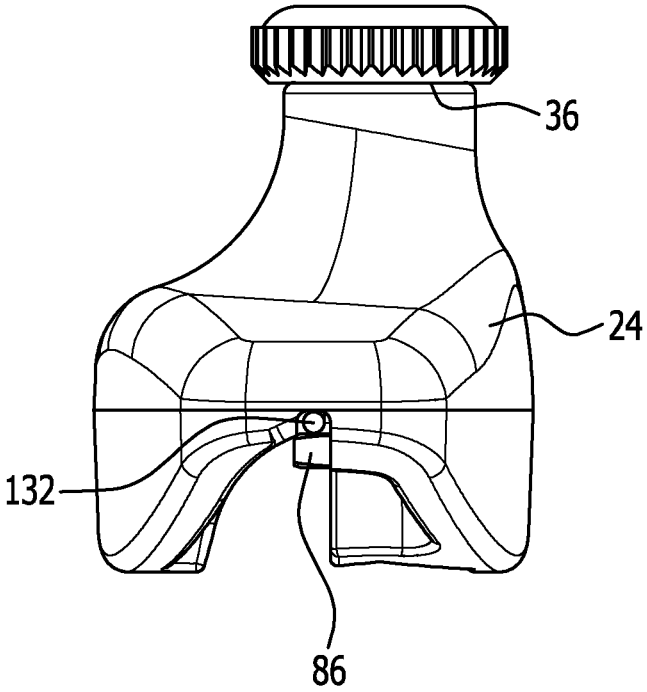
Figure 12:
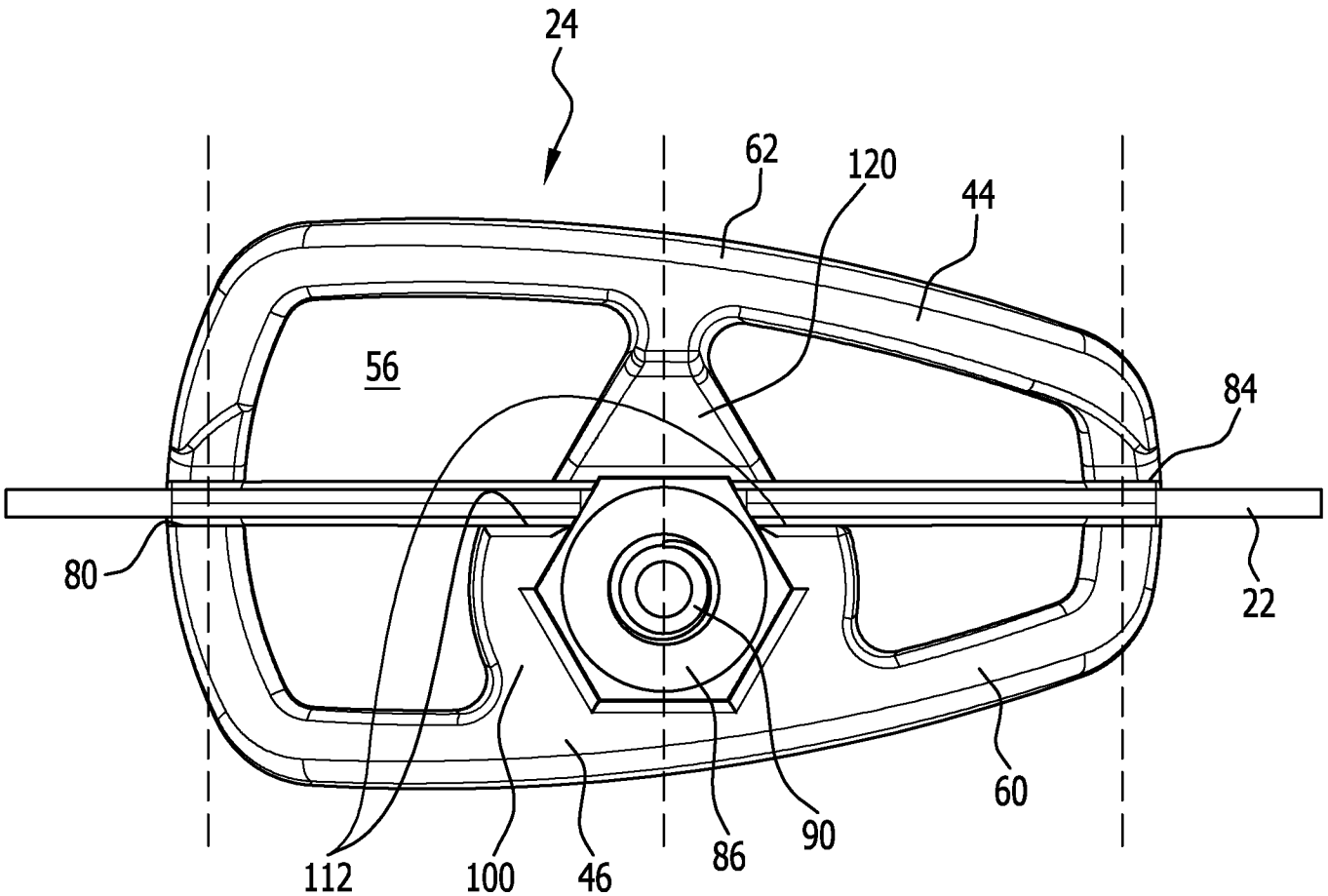
FIG. 12 shows a view from below of the fine tuner according to FIG. 4 in the direction D.

In relation to the height direction 32, the abutment region 46 has an apex region 50 (FIG. 8), from which the abutment region 46 recedes in the length direction 28 in both directions (to the left and to the right in the drawing plane according to FIG. 8) in relation to the height direction 32, that is to say at the apex region 50, in relation to an envelope plane 52 at the upper end 36 of the main body 24, has the greatest spacing from this envelope plane 52 in the height direction 32, and to the left and right of this the spacing from the further abutment region 46 to the envelope plane 52 decreases, and in particular decreases continuously.

The first region 26 has a peripheral wall 54, which surrounds an interior space 56.

The underside 44 of the main body 24 is formed by an end face 58 of the wall 54.

The wall 54 has a first wall region 60 and a second wall region 62. The first wall region 60 and the second wall region 62 are arranged on a body 64 of the first region 26 of the main body 24 and protrude beyond it. The first wall region 60 and the second wall region 62 form the peripheral wall 54 on the body 64, with the interior space 56 being delimited upwardly (opposite the direction 48) by the body 64 in the height direction 32.

In one example, the rest of the abutment region 46 is only formed on the first wall region 60.

The main body 24 has an open side 66, which is oriented transversely to the underside 44 and is delimited by the end face 58 of the second wall region 62 in the height direction 32. A free region 68 is formed on the main body 24 by means of the open side 66. This free region 68 is delimited by the body 64, or rather the second wall region 62. The main body 24 is stepped as a result of this. This free region 68 can receive a string 22, or a string 22 can be guided in a direction 70 by means of the open side 66 into the free region 68. If a string 22 is positioned in the free region 68, this positioning being permanent (see below) or temporary, then it is covered in the height direction 32 upwardly (counter to the direction 48) by the body 64 of the main body 24.

The first wall region 60 has a first end 72 and a second end 74, between which it runs.

The second wall region 62 has a first end 76 and a second end 78, between which it runs. The first end 72 of the first wall region 60 faces the first end 76 of the second wall region 62. The second end 74 of the first wall region 60 faces the second end 78 of the second wall region 62.

In the region of their respective first ends 72 and 76, the first wall region 60 and the second wall region 62 have substantially the same height above body 64. Furthermore, the first wall region 60 and the second wall region have substantially the same height in the region of their respective second ends 74 and 78.

In order to form the other abutment region 46 and because of the free region 68, the first wall region 60 has a greater height outside this transition region than the second wall region 62.

In particular, the first wall region 60 at the apex region 50 has a greater height than the second wall region 62 compared to an equal length position in the longitudinal direction 28.

On the main body 24, a first abutment region 80 for a string 22 is formed. The first abutment region 80 lies between the first end 72 of the first wall region 60 and the first end 76 of the second wall region 62.

The first abutment region is formed at a slot 82 on the underside 44 of the main body 24.

The slot 82 is formed in particular in the further abutment region 46.

This slot 82 has such a width dimension in the width direction 30 that a string 22 can be inserted.

Furthermore, a second abutment region 84 is formed on the main body 24, which is spaced apart from the first abutment region 80 in the length direction 28. This second abutment region 80 is formed as a slot and is located in particular between the second end 74 of the first wall region 60 and the second end 78 of the second wall region 62. The first abutment region 80 and the second abutment region 84 are aligned with each other in the length direction 28.

The second abutment region 84 is basically the same as the first abutment region 80 and is used to receive the string 22.

The fine tuner 12 comprises a gripping element 86 for gripping and tensioning a string 22. The gripping element 86 is held on an adjusting device 88, which is located on the main body 24.

The adjusting device 88 comprises a spindle 90, which is mounted on the main body 24 so that it can rotate about an axis of rotation 92, The axis of rotation 92 is, in particular, parallel to the height direction 32.

The spindle 90 is passed through the second region 34 and is, in particular, rotatably mounted there.

At the end of spindle 90 there sits an actuating element 94, in particular in the form of a knurled knob. The actuating element 94 is positioned at the upper end 36 of the second region 34.

By turning the actuating element 94, a user can turn the spindle 90.

The spindle 90 is, in particular, fixed against displacement (in relation to the height direction 32) and is captively mounted on the main body 24.

For example, the spindle 90 is mounted on the main body 24 by means of a slide bearing as a rotary bearing so that the spindle can rotate about the axis of rotation 92.

The spindle 90 has a threaded region 96, on which the gripping element 86 sits. The threaded region 96 is, in particular, an external thread and the gripping element 86 has an internal thread, which engages in the threaded region 96.

The gripping element 86 can be rotated relative to the spindle 90 about the axis of rotation 92.

A displacement guide 98 is provided for the gripping element 86. The displacement guide 98 comprises a sleeve 100. The sleeve 100 sits on the body 64 and protrudes from it in the height direction 32. The sleeve 100 is connected in particular to the first wall region 60 at the apex region 100.

The sleeve 100 has an interior space 102. The spindle 90 with its threaded region 96 is located in this interior space 102. Furthermore, the gripping element 86 is positioned in this interior space 102.

The sleeve 100 is adapted to the gripping element 86 in such a way that the gripping element 86 is positioned non-rotatably in the interior space 102. A rotation of the spindle 90 about the axis of rotation 92 thus causes a displacement of the gripping element 86 in the height direction 32 in the direction 48 or in the opposite direction, depending on the direction of rotation of the spindle 90 (initiated by means of the actuating element 94).

The sleeve 100 has a sleeve axis 104, which is parallel to a displacement axis 106 of the displacement guide 98. The displacement axis 106 in turn is parallel to the height direction 32, or rather parallel to the axis of rotation 92.

The gripping element 86 and the interior space 102 thus matched are not rotationally symmetrical in relation to the sleeve axis 104 in order to achieve the rotationally fixed coupling.

In one example, the interior space 102 has the shape of an n-sided hollow in cross-section, where n is six in particular, i.e. the interior space 102 is hexagonal in cross-section.

The gripping element 86 has a hexagonal shape matched thereto.

The gripping element 86 is, in particular, slidingly guided in the sleeve 100 along the displacement axis 106.

The sleeve 100 has an open side 108, which faces the free region 68 and which also faces the second wall region 62. The open side 108 faces away from the first wall region 60.

The open side 108 lies on a wall 110 of the sleeve 100. This wall 110 defines a third abutment region 112 for the string 22. The third abutment region 112 has, in particular, a flat abutment surface 114. This flat abutment surface 114 is oriented parallel to the sleeve axis 104 or the displacement axis 106 (or the axis of rotation 92). It is in alignment with the first abutment region 80 and the second abutment region 84, i.e. a straight line which passes through the first abutment region 80 and the second abutment region 84 and which is, in particular, oriented parallel to the longitudinal direction 28 also touches the third abutment region 112 (with a maximum deviation equal to or less than one string thickness).

The gripping element 86 is constructed so that it protrudes with a region 116 from the sleeve 100 on the open side 108.

The fine tuner 12 has a centre plane 118 (see FIG. 7*a*), which is parallel to the longitudinal direction 28 and runs through the first abutment region 80 and the second abutment region 84. In particular, the third abutment region 112 lies in this centre plane 118 or at most one string thickness away from it.

The region 116 of the gripping element 86 protrudes in the direction of the second wall region 62 beyond this centre plane 118.

A counter element 120 is arranged on the body 64 opposite the open side 108 of the sleeve 100. This counter element 120 is spaced from the sleeve 100. Between the counter element 120 and the sleeve 100 there is formed a slot 122, which is limited in the height direction 32 by the body 64. A string 22 can be passed through this slot 122, or can be positioned in the slot 122.

The counter element 120 protrudes above the body 64. It has a height in the height direction 32 (with respect to the protrusion spacing) which is smaller than that of the sleeve 100. In particular, the counter element 120 does not protrude beyond the second wall region 62 and, for example, has a smaller height than this.

In one embodiment, the second counter element 120 with the second wall region 62 is, in particular, in the region of a centre of the second wall region 62 (in relation to the length direction 28). It is set back in relation to the end face 58 of the second wall region 62.

A spacing between the counter element 120 and the sleeve 100 is arranged so that the region 116 of the gripping element 86 can be positioned in the slot 122.

The gripping element 86 is formed by a nut 124, which sits on the spindle 90.

This nut 124 has a slot 126 in particular in the form of an annular slot. In particular, this slot 126 is located at least approximately in the middle between a lower end 128 and an upper end 130 of the nut 124 with respect to the height direction 32.

In an alternative embodiment, the gripping element 86 is formed by means of a first nut and a second nut, the two nuts being spaced apart from one another. Due to the spacing, a (ring) slot is formed between them.

The slot 126 is used to receive a string 22, moreover a string portion 132, which is positioned between the first abutment region 80 and the second abutment region 84 and is positioned there abutting against the main body 24 in the interior space 56.

In one embodiment, the slot 126 is arranged and configured to receive the string portion 132 when the corresponding string 22 is in contact with the third abutment region 112 on the sleeve 100.

Relative to the longitudinal direction 28, the sleeve 100 and the spindle 90 are positioned at least approximately centrally between the first abutment region 80 and the second abutment region 84 on the main body 24.

The main body 24 has a centre plane 134 which is perpendicular to the centre plane 118 and to which the height direction 32 is parallel. Furthermore, the width direction 30 is parallel to this centre plane 134. The longitudinal direction 28 is perpendicular to this centre plane 134. (The longitudinal direction 28 is parallel to the centre plane 118 and the height direction 32 is parallel to the centre plane 118; the width direction 30 is perpendicular to the centre plane 118).

In one embodiment (see FIG. 5), the fine tuner 12 is not symmetrical with respect to the centre plane 118; the axis of rotation 92 is offset in the width direction 30 from the centre plane 118. It lies, in particular, in the centre plane 134.

Accordingly, the sleeve 100 of the sleeve axis 104 is then positioned offset to the centre plane 118; the displacement axis 106 does not lie in the centre plane 118. See also FIG. 10.

The spindle 90 of the adjusting device 88 is held captively on the main body 24. The corresponding rotary bearing is formed in such a way that, in particular, no displacement of the spindle 90 is possible and, in relation to the height direction 32, the spindle 90 is always positioned identically on the main body 24. Furthermore, the gripping element 86 is held captively on the spindle 90.

A fine tuner 12 according to the invention functions as follows:

The fine tuner 12 is placed on a string 22 in a starting position of the gripping element 86.

In an embodiment with the free region 68, the fine tuner 12 can be placed from above or in direction 70 until the string 22 contacts the third abutment region 112 (on the abutment surface 114).

Figure 7A:
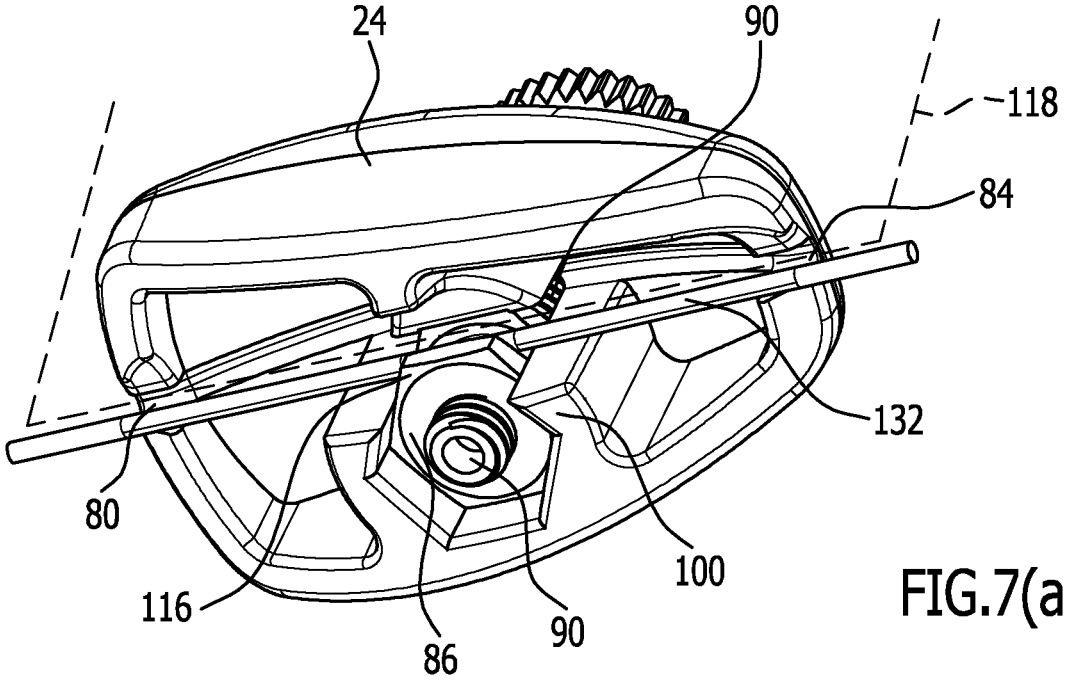
FIG. 7(*a*) shows the same view as FIG. 6 in a starting position.
Figure 7B:
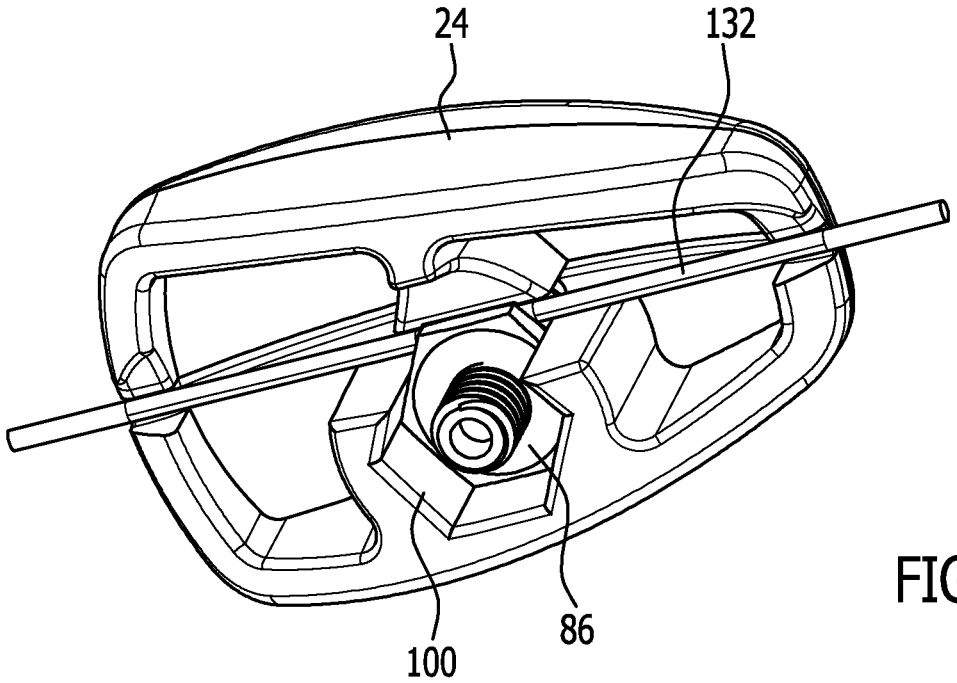

The gripping element 86 is positioned in the starting position so that the string 22 can be introduced into the slot 126 (FIGS. 7(*a*), 9(*a*), 11(*a*)).

By placing the fine tuner 12 on the corresponding string 22, the string is in contact with the first abutment region 80 and the second abutment region 84 of the main body 24.

In particular, it is also provided that the further abutment region 46 is placed against the bridge 16 of the string musical instrument (see FIG. 3). The convex form of the abutment region 46 means that there is a certain amount of variability for the contact.

In principle, it is also possible to fix the fine tuner 12 only on a string 22, without abutment against a body of the string musical instrument. It is also possible that the fine tuner 12 is fixed to a played region of the string 22 (in the example of the musical instrument 10 then between the string holder 20 and the bridge 16) on the particular string 22 to be tuned.

By pushing the gripping element 86 upwardly in the height direction 32 counter to the direction 48, the string 22 is deflected at the fine tuner 12 and tensioned. The string 22 is in contact with both the first abutment region 80 and the second abutment region 84. The sliding of the gripping element 86 in the height direction 32 is effected by rotating the actuating element 94 about the axis of rotation 92 in the appropriate direction. This rotation causes the spindle 90 to rotate relative to the gripping element 86. The rotationally fixed positioning of the gripping element 86 in the interior space 102 of the sleeve 100 then causes a relative displacement of the gripping element 86 in the sleeve 100.

By displacing the gripping element 86 in the height direction 32, the string portion 132, which is located between the first abutment region 80 and the second abutment region 84, and which is positioned with a region in the slot 126, is entrained and thus the string 22 is deflected (see FIGS. 7(*b*), 9(*b*), 11(*b*)).

By displacing the gripping element 86 in the height direction 32 counter to the direction 48, the string is pulled and in particular pulled away from the body (sounding body 14) of the string musical instrument 10. This allows fine tuning when space is tight, since the string 22 is moved away from the sounding body 14 (in contrast to a movement towards the sounding body).

Furthermore, the fine tuner 12 can be positioned retrospectively on the string 22 and a fine tuning of the string 22 can be achieved. The fine tuner 12 does not need to be mounted on the string musical instrument 10 outside the string 22, By pulling the string portion 132 up by means of the gripping element 86, the fine tuner 12 itself provides abutment surfaces (namely the abutment regions 80, 84) as counter surfaces. The gripping element 86 pulls the string portion 132 upwardly relative to the abutment regions 80, 84.

This allows the string 22 to be tuned by means of the fine tuner 12 without having to turn the holding peg 18.

In this way a high degree of tuning precision can be achieved.

FIGS. 6, 8, 10, 12 show a possible final position of the gripping element 86 with tuning of the string 22 having been achieved.

In particular, the gripping element 86 is then positioned opposite the counter element 120, and in one embodiment there may be contact. The region of the string portion 132 positioned in the slot 126 is then also positioned in the slot 122. The counter element 120 on the one hand and the third abutment region 112 on the other hand prevent this region of the string portion 132 from "slipping out" of the slot 126. The counter element 120 covers the slot 126 facing away from the sleeve 100.

While the string 22 is being tuned by means of fine tuner 12, the string portion 132 in particular is in contact with the third abutment region 112. When moving the gripping element 86 in the height direction 32, it can slide along the third abutment region 112, This results in effective tunability.

The fine tuner 12 can be made compact so that it can be used, for example, also for a zither instrument (FIGS. 1 to 3) having a large number of strings 22 spaced relatively closely to one another, and each string 22 can be associated with its own fine tuner 12.

This results in the possibility for fine tuning with a compact fine tuner 12, which is precise and easy to operate.

In particular, it is possible, by means of the abutment region 46, to support the fine tuner on the musical instrument 10, moreover on a body (such as the bridge 16) of the musical instrument 10.

The free region 68 allows a string 22 to be easily positioned on the fine tuner 12, or rather allows the fine tuner 12 to be easily positioned on a string 22, in particular between the bridge 16 and the holding peg 18.

The construction of the fine tuner 12 with a relatively small width in the width direction 30 (in relation to the length direction 28), with the length in the length direction 28 being at least 1.2 times greater than the width B of the width direction 30 (and preferably at least 1.5 times greater) in one embodiment in particular, means that fine tuners 12 can also be used when the spacing between adjacent strings 22 is relatively small.

Figure 13:
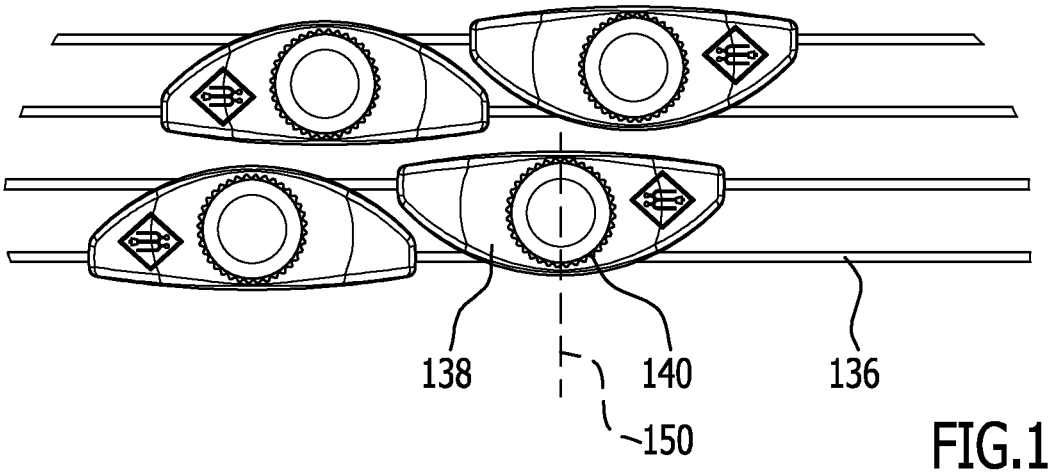
FIG. 13 shows a plurality of strings of a string musical instrument, on each of which a further embodiment of a fine tuner according to the invention is arranged, in a plan view.

FIG. 13 shows a plan view of an example in which a number of fine tuners 138 are each arranged on separate strings 136. The fine tuners 138 are basically the same as described above with an adjusting device 88 with sleeve 100.

An actuating element 140 in the form of a rotary knob is provided. The fine tuners 138 have a first abutment region 142 and a second abutment region 144, as described above.

The fine tuners 138 also have a free region 146, which is arranged and configured in such a way that a string 136' which is adjacent to a string 136' which is to be tuned can be positioned in said free region without contact.

Figure 14:
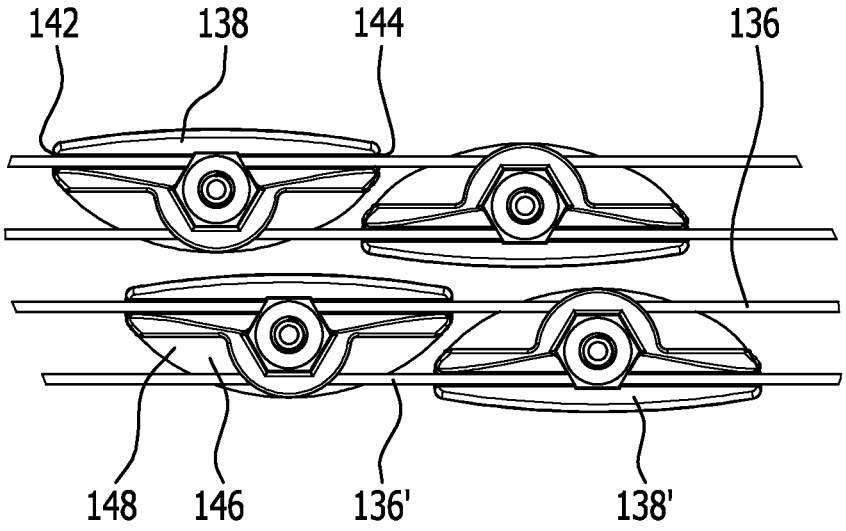
FIG. 14 shows a view from below of the arrangement according to FIG. 13.

When the fine tuner 138 is held at the string 136, it also covers the string 136' upwardly by means of its main body 148. A separate fine tuner 138' is provided for the string 136' (see FIG. 14).

The free region 146 allows a plurality of fine tuners to be used on a string musical instrument, even if the strings 136, 136' are spaced closely together.

The fine tuners 138, 138' may be formed to be symmetrical with respect to a centre plane 150, which is perpendicular to a longitudinal direction between the first abutment region 142 and the second abutment region 144.

An additional clearance 146 is provided, which prevents the fine tuner 138 from touching an adjacent string (string 136' to be tuned by another fine tuner).

In addition, the free region corresponding to the free region 68 can be provided for lateral insertion and positioning on the sleeve 100.

According to the invention, a fine tuner 12 is provided for a string musical instrument 10, and especially for a zither instrument such as a zither or a table harp, which fine tuner can be made compact with a relatively simple construction. A precise fine tuning of strings 22 can be achieved. The slip-stick effect, which occurs when tuning by means of the holding peg 18 for a string 22, is avoided.

If necessary, the fine tuner 12 can be supported by means of the abutment region 46 on the body of the string musical instrument 10.

A user can easily carry out fine tuning by turning the spindle 90 by means of the actuating element 94.

Figure 16:
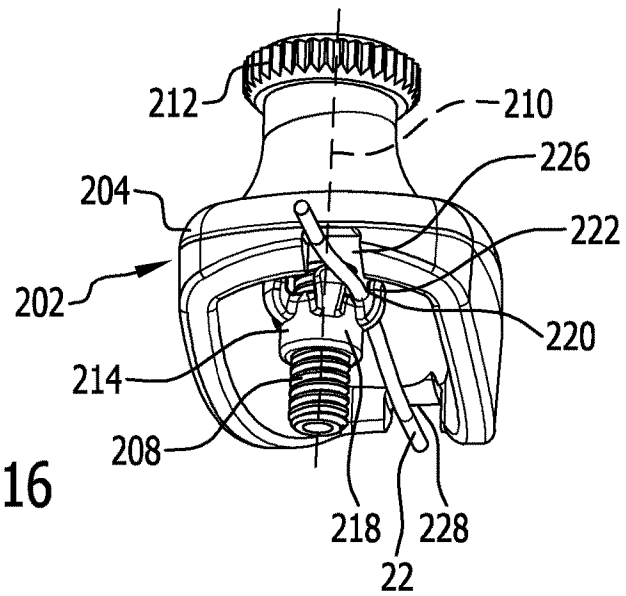
FIG. 16 shows a different perspective view of the fine tuner according to FIG. 15.
Figure 15:
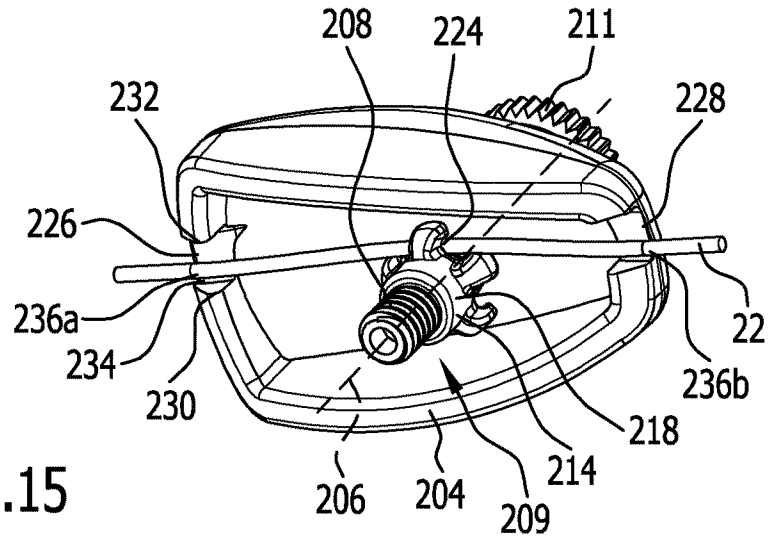
FIG. 15 shows a first perspective view of a further fine tuner according to the invention.
Figure 17:
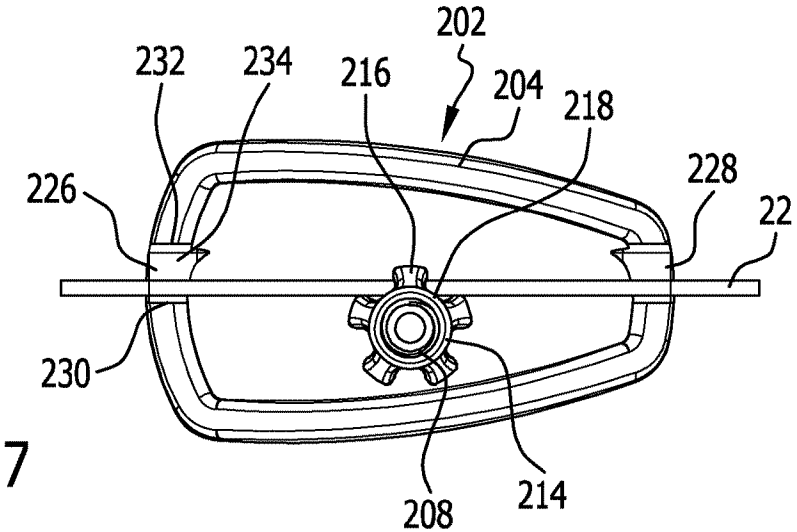
FIG. 17 shows a view from below of the fine tuner according to FIG. 15.

A further example of a fine tuner according to the invention, which is shown in FIGS. 15 to 17 and denoted by 202, comprises a main body 204. A spindle 208 of an adjusting device 209 is arranged captively on the main body 204 and can be rotated about an axis of rotation 206. The axis of rotation 208 is parallel to a height direction 210 of the main body 204 and thus also of the fine tuner 202.

The spindle 208 is connected to an actuating element 212 for conjoint rotation.

A gripping element 214 sits on the spindle 208. The spindle 208 is provided with an external thread. The gripping element 214 is designed as a nut with an adapted internal thread.

In principle, the gripping element 204 is positioned on the spindle 208 so as to be able to rotate about the axis of rotation 206. The gripping element 214 can be rotated relative to the spindle 208. It is also possible to rotate the gripping element 214 about the axis of rotation 206 with rotation of the spindle 208.

The gripping element 214 comprises a plurality of gripping hooks 216. The gripping hooks 216 are peripherally distributed in relation to the axis of rotation 206 and in particular are evenly distributed on a nut element 218 of the gripping element 214. The nut element 218 sits directly on the spindle 208.

The gripping hooks 216 each have a blocking surface 220 on a lug 222. The blocking surface 220 is at least approximately parallel to the axis of rotation 206. (A normal to the blocking surface 220 is perpendicular to the axis of rotation 206).

A gripping hook 216 is open upwardly in the height direction 210, so that a string 22 can be inserted into a gripping hook 216 from above. For this purpose, receptacles 224 associated one with each gripping hook 216 are formed on the gripping element 214. The receptacles 224 are delimited laterally outwardly by the blocking surface 222.

A first abutment region 226 is formed on the main body 204. Furthermore, a second abutment region 228 is formed on the main body at a spacing from the first abutment region 226.

The first abutment region 226 comprises a first blocking region 230 and an opposite second blocking region 232 the first blocking region and the second blocking region 232 are oriented at least approximately parallel to the axis of rotation 206. (A normal of the first blocking surface 230 or 232 lies transversely and in particular perpendicularly to the axis of rotation 206).

Between the first blocking surface 230 and the second blocking surface 232 there is an abutment surface 234 for the string 22. The abutment surface 234 is oriented transversely to the axis of rotation 206.

The second abutment region 228 is basically the same as the first abutment region 226 with first blocking surface, second blocking surface, and abutment surface.

The abutment surface 234 is an abutment surface for the string 22 which allows the string 22 to be supported on the main body 204 upwardly in the height direction 210.

The first blocking surface 230 and the second blocking surface 232 are blocking surfaces which by contact prevent the string 22 from deflecting in a direction transverse to the axis of rotation 206.

Whether the first blocking surface 230 or the second blocking surface 232 is effective depends on the direction of rotation of the spindle 208 about the axis of rotation 206.

The fine tuner 210 functions as follows:

When positioning the fine tuner 202 on a string 22, the string is hooked in at a suitable gripping hook 216. The string is positioned in the corresponding holder 224 from above in the height direction 210.

The fine tuner 202 is first placed on the string 22 from above. The spindle 208 is placed against the string 22, with the gripping element 204 being arranged at such a height position that the string 22 can then be gripped. The spindle 208 is then turned until the string 22 hooks onto a gripping hook 216. The string 22 then contacts the relevant abutment surface 234 of the first abutment region 226 and the second abutment region 228.

The actual fine-tuning process then takes place. The spindle 208 is turned by means of the actuating element 212. In so doing, the gripping element 214 is firstly entrained with the spindle 208, which means that the rotation of the spindle 208 causes a synchronous rotation of the gripping element 214 at the spindle 208. As a result of this, depending on the direction of rotation, the string 22 with regions 236*a*, 236*b* contacts the first blocking surface 230 of the first abutment region 226 and the second abutment region 228, or the second blocking surface 232 of the first abutment region 226 and the second abutment region 228. The contact at the first blocking surfaces 230 or the second blocking surfaces 232 is determined by the direction of rotation.

The gripping hook 216 is hooked to the string 22. Further rotation of the gripping element 214 in this direction of rotation is then blocked; the string 22 and in particular the string region which abuts against the blocking surfaces 230 or 232 between the first abutment region 226 and the second abutment region 228 blocks the gripping element 214 from rotating further relative to the main body 204.

A further rotation of spindle 208 in this direction of rotation then causes a displacement of the gripping element 214 towards the spindle 208 in the height direction 210 due to this blocked rotation of the gripping element 214 towards the main body 204; the gripping element 214 can then rotate relative to the spindle 280. Due to the blocked rotation, this causes (due to the rotation of the spindle 208 relative to the main body 204) a height displacement of the gripping element 204 on the spindle 208 and in particular also of the gripping hook 216, which has gripped the string 22, in the height direction 210.

This results in a deflection of the string 22 in the corresponding height direction 210, and fine tuning can be carried out.

In the case of the fine tuner 202, a rotationally fixed positioning of the gripping element 214 in relation to the main body 204 is established after a kind of "jamming" with the string 22, with the blocking surfaces 230 and 232 being important here.

After this blocking of rotation, a displacement movement of the gripping element 214 in the height direction 210 takes place as rotation continues.

The string 22 is necessary for a rotationally fixed positioning of the gripping element 214 in relation to the main body 204.

In the case of the fine tuners 12 and 202, the essential deflection for a fine tuning process on a string 22 is achieved by displacing the gripping element 214 in the height direction 210.

Otherwise, the fine tuner 202 functions as described above.

In principle, it is also possible, alternatively or additionally, that a substantial deflection of a string 22 is implemented in a direction transverse to the height direction 210, for example, by means of a rotational movement resulting in a lateral deflection (a transverse deflection).

As mentioned, a combination of transverse deflection and height deflection is also possible.

LIST OF REFERENCE SIGNS

10 String musical instrument
12 Fine tuner
14 Sounding body
16 Bridge
18 Holding peg
20 String holder
22 String
24 Main body
26 First region
28 Length direction
30 Width direction
32 Height direction
34 Second region
36 Upper end
38 Transition region
40 Top side
42 Rounded edges
44 Underside
46 Further abutment region
48 Direction
50 Apex region
52 Envelope plane
54 Wall
56 Interior space
58 End face
60 First wall region
62 Second wall region
64 Body
66 Open side
68 Free region
70 Direction
72 First end

74 Second end
76 First end
78 Second end
80 First abutment region
82 Slot
84 Second abutment region
86 Gripping element
88 Adjusting device
90 Spindle
92 Axis of rotation
94 Actuating element
96 Threaded region
98 Displacement guide
100 Sleeve
102 Interior space
104 Sleeve axis
106 Displacement axis
108 Open side
110 Wall
112 Third abutment region
114 Abutment surface
116 Region
118 Centre plane
120 Counter element
122 Slot
124 Nut
126 Slot
128 Lower end
130 Upper end
132 String portion
134 Centre plane
136 String
136' String
138 Fine tuner
138' Fine tuner
140 Actuating element
142 First abutment region
144 Second abutment region
146 Free region
148 Main body
150 Centre plane
202 Fine tuner
204 Main body
206 Axis of rotation
208 Spindle
209 Adjusting device
210 Height direction
212 Actuating element
214 Gripping element
216 Gripping hooks
218 Nut element
220 Blocking surface
222 Lug
224 Receptacle
226 First abutment region
228 Second abutment region
230 First blocking surface
232 Second blocking surface
234 Abutment surface
**236*a*** String region
**236*b*** String region

What is claimed is:

1. A fine tuner for a string musical instrument, comprising a main body having an underside, a top side, a first abutment region and having a second abutment region for a string, wherein the second abutment region is spaced apart from the first abutment region;

a gripping element for gripping a string portion that is located between the first abutment region and the second abutment region; and an adjusting device, which sits on the main body and acts on the gripping element;

wherein a position of the gripping element relative to the main body is adjustable in a fixable manner using the adjusting device and the position of the gripping element determines a deflected position of the string at the fine tuner; and wherein the gripping element entrains the string portion counter to a direction that extends in a direction from the top side to the underside.

2. A fine tuner in accordance with claim 1, wherein at least one of (i) a height position of the gripping element along a height direction relative to the first abutment region and the second abutment region is adjustable in a fixable manner and (ii) a rotational position of the gripping element about an axis of rotation parallel to the height direction is adjustable in a fixable manner.

3. A fine tuner in accordance with claim 1, wherein a displacement guide for the gripping element is arranged on the main body.

4. A fine tuner in accordance with claim 3, wherein the displacement guide has a sleeve in which the gripping element is guided.

5. A fine tuner in accordance with claim 4, wherein a sleeve axis is parallel to a displacement axis of the displacement guide, the displacement axis being parallel to the height direction.

6. A fine tuner in accordance with claim 4, wherein the sleeve has at least one open side.

7. A fine tuner in accordance with claim 6, wherein the gripping element protrudes beyond the open side.

8. A fine tuner in accordance with claim 6, wherein a third abutment region for a string is formed on the open side.

9. A fine tuner in accordance with claim 8, wherein the third abutment region has a flat abutment surface.

10. A fine tuner in accordance with claim 3, wherein the displacement guide is adapted to the gripping element in such a way that the gripping element is guided non-rotatably.

11. A fine tuner in accordance with claim 3, wherein a counter element for the gripping element is arranged on the main body, which counter element has a shorter height than the displacement guide along a displacement axis.

12. A fine tuner in accordance with claim 11, wherein the counter element at least one of (i) delimits a slot for receiving a string and (ii) covers a slot of the gripping element at a certain height position of the gripping element.

13. A fine tuner in accordance with claim 1, wherein a blocking of a rotatability of the gripping element is effected via the string which is held on the gripping element and contacts the main body.

14. A fine tuner in accordance with claim 13, wherein at least one of (i) the first abutment region and (ii) the second abutment region has at least one blocking surface which is oriented parallel to an axis of rotation.

15. A fine tuner in accordance with claim 14, wherein at least one of (i) the first abutment region and (ii) the second abutment region has opposite blocking surfaces, between which there lies an abutment surface with an orientation transverse to the axis of rotation.

16. A fine tuner in accordance with claim 13, wherein the gripping element comprises at least one gripping hook with a blocking surface oriented parallel to the axis of rotation.

17. A fine tuner in accordance with claim 16, having a plurality of gripping hooks.

18. A fine tuner in accordance with claim 1, wherein the adjusting device has a spindle that sits rotatably on the main body.

19. A fine tuner in accordance with claim 18, wherein the gripping element sits on the spindle.

20. A fine tuner in accordance with claim 18, wherein an actuating element sits on the spindle for conjoint rotation and is positioned outside the main body.

21. A fine tuner in accordance with claim 1, wherein the gripping element has a receptacle to hold the string.

22. A fine tuner in accordance with claim 21, wherein the receptacle is formed as a slot.

23. A fine tuner in accordance with claim 21, wherein the receptacle is formed on a gripping hook.

24. A fine tuner in accordance with claim 1, wherein the gripping element is or comprises a nut.

25. A fine tuner in accordance with claim 24, wherein the nut comprises a slot as receptacle for the string, or a first nut and a second nut are provided, with a slot being arranged between the first nut and the second nut to accommodate the string.

26. A fine tuner in accordance with claim 1, wherein a further abutment region is formed on the main body for contact with a body of the string musical instrument.

27. A fine tuner in accordance with claim 26, wherein the further abutment region is formed on the underside of the main body.

28. A fine tuner in accordance with claim 27, wherein an actuating element of the adjusting device is positioned facing away from the underside.

29. A fine tuner in accordance with claim 26, wherein the further abutment region has an abutment surface which is convexly curved.

30. A fine tuner in accordance with claim 1, wherein the first abutment region and the second abutment region are open towards the underside of the main body.

31. A fine tuner in accordance with claim 1, wherein a receiving region of the main body for the string is open to the underside of the main body.

32. A fine tuner in accordance with claim 1, wherein at least one of the first abutment region and the second abutment region are formed at a slot of the main body.

33. A fine tuner in accordance with claim 1, wherein at least one of the first abutment region and the second abutment region is formed at a slot in a further abutment region of the main body for contact with a body of a string musical instrument.

34. A fine tuner in accordance with claim 1, wherein the gripping element is positioned at least approximately centrally between the first abutment region and the second abutment region.

35. A fine tuner in accordance with claim 1, wherein a slot for the string is formed on the main body between the first abutment region and the second abutment region.

36. A fine tuner in accordance with claim 35, wherein the slot is formed between a sleeve for a displacement guide of the gripping element and a counter element positioned on the main body.

37. A fine tuner in accordance with claim 1, wherein the main body has a length in a length direction between the first abutment region and the second abutment region which is greater than a width in a width direction transverse to the length direction.

38. A fine tuner in accordance with claim 1, wherein the main body has at least one open side, which is oriented transversely to the underside of the main body, at least one free region being formed on the main body on the at least one open side, which free region is delimited upwardly in the height direction by a region of the main body.

39. A fine tuner in accordance with claim 38, wherein a sleeve of a displacement guide delimits the at least one free region.

40. A fine tuner in accordance with claim 37, wherein the at least one free region is open downwardly in the height direction.

41. A fine tuner in accordance with claim 37, wherein the main body at the at least one free region is step-shaped.

42. A fine tuner in accordance with claim 1, wherein the main body has a first region, where the first abutment region and the second abutment region are formed, and has a second region, where the adjusting device sits, the second region sitting in domelike manner on the first region and an actuating element of the adjusting device being positioned above the second region.

43. A string musical instrument, comprising at least one fine tuner, said fine tuner comprising: a main body having an underside, a top side, a first abutment region and having a second abutment region for a string, wherein the second abutment region is spaced apart from the first abutment region;

a gripping element for gripping a string portion that is located between the first abutment region and the second abutment region; and an adjusting device, which sits on the main body and acts on the gripping element;

wherein a position of the gripping element relative to the main body is adjustable in a fixable manner using the adjusting device and the position of the gripping element determines a deflected position of the string at the fine tuner; and wherein the gripping element entrains the string portion counter to a direction that extends in a direction from the top side to the underside.

44. A string musical instrument in accordance with claim 43, wherein the at least one fine tuner is positioned on a string region between a bridge and a holding peg.

45. A string musical instrument in accordance with claim 43, wherein the fine tuner is supported by the main body with a further abutment region on a body of the string musical instrument.

46. A string musical instrument, wherein said instrument is a zither instrument.

* * * * *